US010370074B2

(12) United States Patent
Byrd et al.

(10) Patent No.: US 10,370,074 B2
(45) Date of Patent: Aug. 6, 2019

(54) UNDERWATER VEHICLE FOR INSPECTION OF A SUBSEA STRUCTURE IN A BODY OF WATER AND RELATED METHOD

(71) Applicant: TOTAL SA, Courbevoie (FR)

(72) Inventors: Daniel Byrd, Idron (FR); Amin Nasr, Idron (FR); Jean Vittonato, Pau (FR)

(73) Assignee: TOTAL SA, Courbevoie (FR)

( * ) Notice: Subject to any disclaimer, the term of this patent is extended or adjusted under 35 U.S.C. 154(b) by 0 days.

(21) Appl. No.: 15/570,913

(22) PCT Filed: May 5, 2015

(86) PCT No.: PCT/IB2015/000803
§ 371 (c)(1),
(2) Date: Oct. 31, 2017

(87) PCT Pub. No.: WO2016/178045
PCT Pub. Date: Nov. 10, 2016

(65) Prior Publication Data

US 2018/0290717 A1 Oct. 11, 2018

(51) Int. Cl.

| | |
|---|---|
| ***B63C 11/52*** | (2006.01) |
| ***B63G 8/00*** | (2006.01) |
| ***C23F 13/22*** | (2006.01) |

(52) U.S. Cl.
CPC ..... *B63C 11/52* (2013.01); *B63G 8/001* (2013.01); *C23F 13/22* (2013.01); *B63G 2008/004* (2013.01); *B63G 2008/005* (2013.01); *B63G 2008/007* (2013.01); *C23F 2213/31* (2013.01)

(58) Field of Classification Search
CPC ..... B63C 11/52; B63G 8/001; C23F 13/22
See application file for complete search history.

(56) References Cited

U.S. PATENT DOCUMENTS 2,311,539 A * 2/1943 Hanley ..... B63G 8/26 114/238
2014/0230713 A1 8/2014 Kimura et al.

FOREIGN PATENT DOCUMENTS

| | | |
|---|---|---|
| GB | 2124382 A | 2/1984 |
| WO | 02054110 A1 | 7/2002 |
| WO | 02054635 A1 | 7/2002 |

OTHER PUBLICATIONS

"Will ROV-AUV Hybrids Be the Next Generation of Work Vehicles?" James R. McFarlane, Proceedings of The Fifth (2002) ISOPE Pacific/Asia Offshore Mechanic Symposium, Nov. 17-20, 2002, Daejeon, Korea.

(Continued)

*Primary Examiner* — Stephen P Avila
(74) *Attorney, Agent, or Firm* — Troutman Sanders LLP

(57) ABSTRACT

The vehicle includes a support body, able to move along the subsea structure in a body of water, a lower proximity sensor, deployable from the support body towards the subsea structure, the lower proximity sensor comprising a lower cathodic protection probe, the lower proximity sensor being deployable between a retracted position and a deployed position. It also comprises an upper remote sensor deployable from the support body, comprising an upper cathodic protection probe. The lower proximity sensor is located below the support body in the retracted position and in the deployed position.

21 Claims, 4 Drawing Sheets

(56) References Cited

OTHER PUBLICATIONS

"Refining the Roles of ROVs and AUVs in the Next Decade" Mark A. Johnson, Deepwater Research Inc., Offshore Technology Conference, May 2011.
"A vision system for an underwater cable tracker" Alberto Ortiz, Miquel Simó, Gabriel Oliver, Machine Vision and Applications; 2002; pp. 129-140.
"Attenuation Analysis of Survey Data on a Subsea Pipeline with Retrofit Anodes" Stephen N. Smith and Paul Sloan; ResearchGate; https://www.researchgate.net/publication/283565552; Jan. 2005.
International Search Report dated Jan. 21, 2016, issued in corresponding PCT Application No. PCT/IB2015/000803.

* cited by examiner

UNDERWATER VEHICLE FOR INSPECTION OF A SUBSEA STRUCTURE IN A BODY OF WATER AND RELATED METHOD

CROSS-REFERENCE TO RELATED APPLICATIONS

This application is a U.S. national phase application under 35 U.S.C. § 371 of International Patent Application No. PCT/IB2015/000803, filed on May 5, 2015. The entire contents of this application is hereby incorporated by reference.

TECHNICAL FIELD

The present invention concerns an underwater vehicle for inspection of a subsea structure, comprising:

a support body, able to move along the subsea structure in a body of water;

a lower proximity sensor, deployable from the support body towards the subsea structure, the lower proximity sensor comprising a lower cathodic protection probe, the lower proximity sensor being deployable between a retracted position and a deployed position;

an upper remote sensor deployable from the support body, comprising an upper cathodic protection probe.

BACKGROUND

Such a vehicle is designed in particular for inspecting rigid pipes transporting hydrocarbons. The pipes are usually located at the seabed. The aim of the inspection is to detect potential defects resulting from corrosion of the pipes.

Traditionally, pipeline corrosion inspection is carried out with a diver and/or with a remotely operated vehicle (or "ROV"). It is therefore necessary to provide a surface facility above the pipes to be inspected. In the case of a diver, limitations exist regarding the depth at which the intervention can be done. ROV can operate at deeper depths. However, the surface installation is still needed. A link between the ROV and the surface assembly must be deployed to power the ROV. The link is for example an umbilical.

In a known measurement method, the ROV is controlled from the surface to follow the subsea structure. A deployable articulated arm extends from a side of the ROV to place a first proximity cathodic protection probe very close to the pipe to be sensed.

A second remote cathodic protection probe is immersed into the body of water from the surface facility, at a distance from the surface facility to obtain a reference measurement outside the electrical field.

A voltage difference between the proximity probe and the remote probe is measured along the pipe. From time to time, the ROV is touching the pipe directly (at an anode connection for instance), in order to calibrate the voltage difference between the electrode close to the pipe and the one in shallow water.

The method allows a precise corrosion measurement of the surface of the pipe. Nevertheless, the method is time consuming, expensive and requires complex equipment such as a ROV and an associated surface assembly connected to the ROV.

To partially alleviate this problem, US 2014/0230713 discloses an underwater mobile inspection apparatus which is able to cruise autonomously above a pipeline. The apparatus comprises an articulated arm equipped with a proximity cathodic protection probe. The articulated arm is attached to a side of the vehicle.

Such a device is not entirely satisfactory. Indeed, the proximity cathodic protection probe is carried on a cart which rolls on the pipeline. The cart is deployed from the articulated arm, creating a strong drag when cruising the inspection apparatus above the pipe and generates high friction on the pipeline.

As a consequence, the inspection apparatus can only be operated at very slow speeds, with a substantial risk of damaging the surface of the pipeline.

One aim of the invention is to obtain an underwater vehicle suitable for corrosion inspection of a subsea structure, the vehicle being able to be operated at a high speed above the subsea structure.

SUMMARY

To this aim, the subject-matter of the invention is an underwater vehicle as defined above, characterized in that the lower proximity sensor is located below the support body in the retracted position and in the deployed position.

The underwater vehicle according to the invention may comprise one or more of the following features, taken solely or according to any possible technical combination:

the support body defines a longitudinal moving axis, the lower proximity sensor extending below the support body along the longitudinal moving axis in the retracted position.

the lower proximity sensor comprises a lower arm pivotable with regard to the support body around an horizontal axis.

the lower arm is a rigid rod.

the lower arm has a profiled shape.

the lower arm has a length comprised between 1 m and 2.5 m, preferably between 1.5 m and 2 m.

the underwater vehicle comprises a control unit able to control the movement of the lower arm between the retracted position and the deployed position to maintain the lower cathodic protection probe at a fixed altitude above the subsea structure.

the upper remote sensor comprises a fish carrying the upper cathodic protection probe, a flexible line connecting the fish to the support body and a winch, attached to the support body to wind up/unwind the flexible line.

the upper remote sensor comprises a release/capture mechanism of the fish.

the length of the flexible line is greater than 1 m and is advantageously comprised between 3 m and 10 m.

the underwater vehicle comprises a position probe for measuring the position of the upper cathodic protection probe relative to the support body.

the position probe comprises a sensor for measuring the inclination of the flexible line, and a sensor for measuring the length of flexible line deployed from the support body.

the position probe comprises a pressure sensor.

the support body is able to autonomously cruise along the subsea structure, without contact with the subsea structure, the vehicle being an autonomous underwater vehicle.

The invention also relates to a method for inspecting a subsea structure, comprising the following steps:

moving an underwater vehicle as described above, immersed in a body of water above the subsea structure;

deploying the lower proximity sensor below the support body towards the subsea structure;

measuring a potential difference between the upper cathodic protection probe and the lower cathodic protection probe while cruising along the subsea structure.

The method according to the invention may comprise one or more of the following features, taken solely or according to any possible technical combination:

the cruising speed of the support body is greater than 0.9 km/h.

the vehicle is an autonomous underwater vehicle, the moving step comprising autonomously cruising the support body above the subsea structure without contacting the subsea structure.

BRIEF DESCRIPTION OF THE DRAWINGS

The invention will be better understood, based on the following description, given purely as an example, made in reference to the appended drawings, in which.

DETAILED DESCRIPTION

Figure 1:
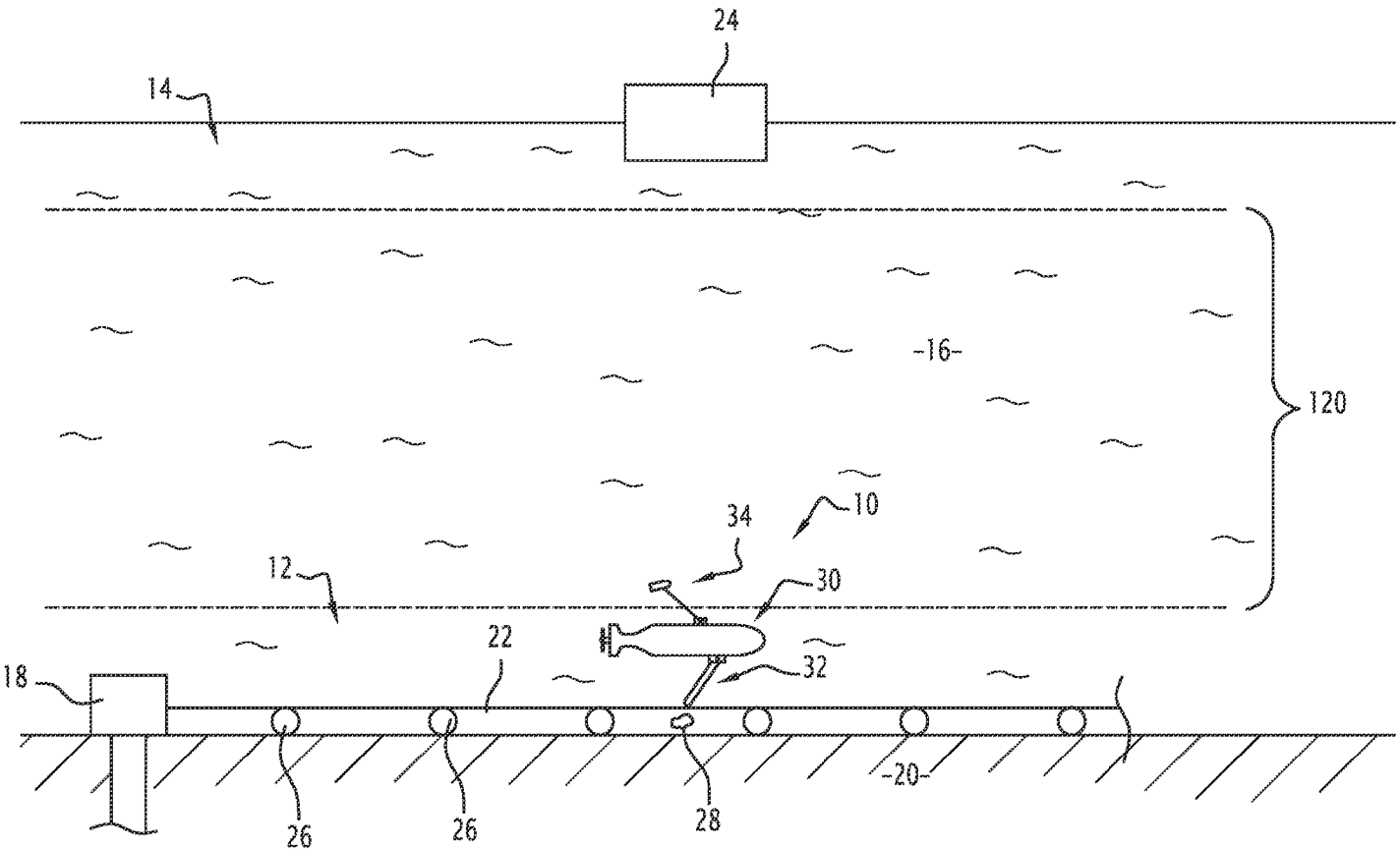
FIG. 1 is a schematic view of a hydrocarbon production installation in which an autonomous underwater vehicle according to the invention operates.
Figure 2:
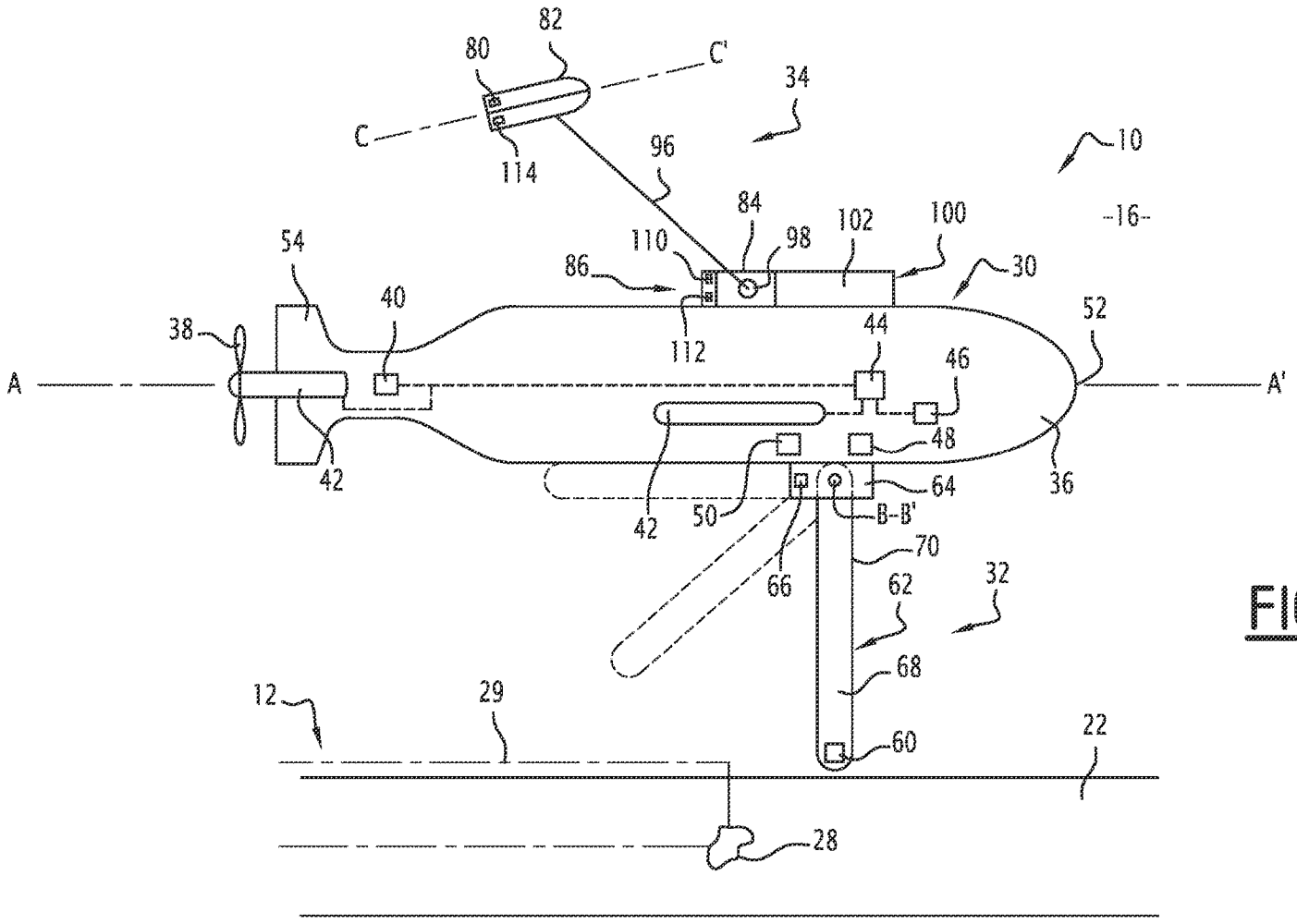
FIG. 2 is an enlarged view of the autonomous underwater vehicle according to the invention.

A first underwater vehicle 10 according to the invention is shown schematically in FIGS. 1 and 2.

In this example, the vehicle 10 is an autonomous underwater vehicle able to autonomously cruise in a body of water 16.

The autonomous underwater vehicle 10 is for inspecting a subsea structure 12 in an installation 14 of production of hydrocarbons through a body of water 16.

The subsea structure 12 comprises for example at least a production well 18 bored in the seabed 20 of the body of water 16, and at least a rigid metallic pipe 22 connecting the well 18 to a storage and/or transportation assembly comprising at least a riser and/or a subsea to shore pipeline (not shown). The subsea structure 12 can also be any subsea structure protected against corrosion by galvanic anode or impressed current cathodic protection. Example of such structures may be risers, rigid or flexible pipelines, buoyancy tanks, mooring lines, etc.

The installation 14 preferably also comprises a surface assembly 24 floating or fixed at the surface of the body of water 16.

The body of water 16 is for example a sea, an ocean, a lake and/or a river. The depth of the body of water 16, taken in the vicinity of the inspected subsea structure 12 is for example comprised between 10 m and 5000 m.

The transportation pipe 22 of the subsea structure is a metallic pipe covered partially or entirely with a protective coating.

The pipe 22 is preferably provided with an anodic protection comprising sacrificial anodes 26 distributed along the pipe 22. The sacrificial anodes 26 are able to corrode to compensate for the corrosion of potential defects 28 located at the coating of the pipe 22. A current flow 29 (see FIG. 2) locally establishes at the surface of the pipe 22 between the sacrificial anodes 26 and the defects 28.

The application of the current flow 29 produces a decrease in the electrochemical potential of the subsea structure 12 and by a local electric field in the water around the subsea structure 12.

The local electric field is generally distributed between the anode 26 and the bare metal at the location of the defect 28.

The efficiency of the protection is a function of the density of cathodic current and hence of the electrode potential obtained. The electrode potential can therefore be measured to assess the efficiency of the protection.

The autonomous underwater vehicle 10 comprises a support body 30, a lower proximity sensor 32, deployable downwardly from the support body 30 to measure a first reference potential in the vicinity of the subsea structure 12, in the cathodic protection zone and an upper remote sensor 34, deployable upwardly from the support body 30 to measure a second reference potential away from the subsea structure 12 and from the cathodic protection zone.

The autonomous underwater vehicle 10 is configured to cruise autonomously in the body of water 16, without physical link to a surface installation above the subsea structure 12. The risk of damaging the subsea structure 12 or the vehicle 10 is thus minimized.

It is able to move along the subsea structure 12 according to a predefined path defined in a control unit of the vehicle 10, or according to a path controlled from the surface through a wireless communication connection.

The support body 30 comprises a profiled hull 36, carrying the lower proximity sensor 32 and the upper remote sensor 34, a propeller 38, and a power source 40 connected to the propeller 38.

The support body 30 further comprises at least a mobile control surface 42 and a control unit 44, able to control the power source 40 to control the propeller 38 and the mobile control surface(s) 42 to drive the vehicle 30 along the predefined path.

Advantageously, the support body 30 comprises at least a position probe 46 able to sense the depth and/or horizontal location of the autonomous underwater vehicle 10.

It further comprises a voltmeter (not shown), able to measure a difference of potential between the first reference potential and the second reference potential and a data storage unit 48 able to store data arising from the position probe 46, from the lower proximity sensor 32, from the upper remote sensor 34 and from the voltmeter.

The support body 30 may comprise a wireless communication unit 50 able to communicate with the surface installation 24 to receive instructions from the surface installation 24 and/or to transmit data stored in the data storage unit 48 to the surface installation 24.

The hull 36 has for example a torpedo shape, with a tapering nose 52 and an enlarged tail 54. The propeller 38 is for example located at the tail 54.

When the propeller 38 is active, the support body 30 is able to cruise along the subsea structure 12 with a speed which can be more than 0.5 knots (i.e., 0.9 km/h), and which can be comprised between 0.5 knots and 2.5 knots (between 0.9 km/h and 4.6 km/h).

The length of the hull 36, taken along a longitudinal axis A-A' of the support body 30 is for example greater than 4 m and comprised between 4 m and 10 m.

The maximum transverse dimension of the hull 36, taken perpendicularly to the longitudinal axis A-A' is for example higher than 0.3 m and comprised between 0.3 m and 2 m.

The lower proximity sensor 32 comprises a lower cathodic protection probe 60 and a deployable arm 62 carrying the lower cathodic protection probe 60.

The lower proximity sensor 32 further comprises a lowering mechanism 64 able to move the deployable arm 62 between an upper retracted position along the support body 30 and a lower deployed position, protruding from the support body 30 towards the subsea structure 12.

The lower proximity sensor 32 advantageously comprises an inclination probe 66, able to determine the angular inclination of the arm 32, with regard to the support body 30.

The lower cathodic protection probe 60 comprises a first measurement electrode. The electrode generally comprises a metal wire immersed in a specific electrolytic solution. The electrolytic solution is placed into contact with the water through an orifice.

The first measurement electrode is for example an Ag/AgCl or a Zinc reference electrode.

The cathodic protection probe 60 has for example a weight comprised between 1 kg and 2 kg in air, a diameter comprised between 20 mm and 100 mm, and a length comprised between 300 mm and 600 mm.

The deployable arm 62 is here made of a rigid rod 68 extending between a front end mounted on the support body 30, and a back end, able to freely deploy in the body of water 16 towards the subsea structure 12.

In this example, the arm 62 is pivotably mounted on the support body 30 around a transverse horizontal axis B-B'. The deployable arm 62 is able to pivot from the retracted position to the deployed position, the free end of the rod 68 moving away from the hull 36, while the front end of the rod 68 remains in a globally invariant position.

The lower cathodic protection probe 60 is fixed on the deployable arm 62, preferably at the free end or in the vicinity of the free end.

The lowering mechanism 64 is able to move the deployable arm 62 between the retracted position and the deployed position. It comprises for example a spring-loaded member, able to generate a permanent spring force on the deployable arm 62 to return it in the retracted position. The lowering mechanism 64 also comprises an actuating member, able to overcome the spring force of the spring-loaded member to move the arm 62 towards the deployed position. The actuating member is also able to maintain the arm 62 in any angular position between the retracted position and the deployed position as shown in FIG. 2.

According to the invention, the lower proximity sensor 30 is located below the support body 30 in the retracted position and also in the deployed position, as well as in any position between the retracted position and the deployed position.

In the example shown on FIG. 2, in the retracted position, the deployable arm 62 extends longitudinally against the lower surface of the hull 36 or in a housing provided in the hull 36. The drag of the deployable arm 62 is minimal.

In the deployed position, the arm 68 extends for example perpendicularly to the longitudinal axis A-A'.

Figure 3:
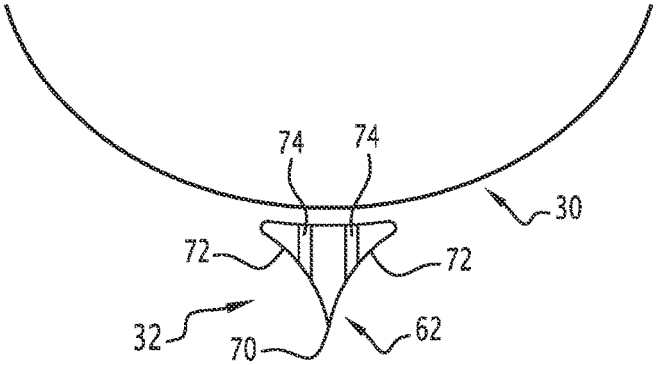
FIG. 3 is a partial sectional view of FIG. 2, illustrating a profiled lower proximity sensor of the vehicle in a retracted position against a support body.

To ensure a minimal disturbance of the hydrodynamics of the hull 36 when the arm 62 is deployed, the arm 62 is preferably profiled. For example, as shown in FIG. 3, it comprises a tapered form, having a tapered longitudinal front edge 70 and lateral extensions 72, defining concave longitudinal surfaces.

In order to further reduce the drag of the arm 62 in the retracted position, internal water circulation passages 74 are advantageously provided longitudinally along the arm 62. The passages 74 open at the front end and at the back end of the arm 62 to allow longitudinal circulation of water through the arm 62. In the example of FIG. 3, the arm 62 has a fin shape.

In a variant, not shown, the lateral extensions 72 are retractable around an axis defined for example by the edge 70, to further reduce the drag when the arm 62 is deployed.

In other variants, the arm 62 is not made of a single piece. It is made for example of a telescoping rod comprising a plurality of telescoping parts with a cable carrier able to control the length of the arm 62.

The inclination probe 66 is connected to the control unit 44. The control unit 44 is then able to control the lowering mechanism 64 to maintain a predetermined altitude of the free end of the arm 62 with regard to the subsea structure 12, based on the inclination data received from the inclination probe 66 and the AUV altitude obtained from probe 46.

The length of the arm 62 is preferably between 1 m to 2.5 m, and preferably between 1.5 to 2 m, to be able to extend sufficiently from the profiled hull 36 towards the subsea structure 12 while maintaining the support body 30 at a sufficient distance of the subsea structure 12.

The upper remote sensor 34 comprises an upper cathodic protection probe 80, a deployable fish 82 carrying the upper cathodic protection probe 80, and an upper deployment mechanism 84 for deploying the deployable fish 82 away from the support body 30.

Advantageously, the upper remote sensor 34 further comprises a position probe 86 for determining the relative position of the deployable fish 82 with regard to the support body. The position probe 86 is connected to the control unit 44 for controlling the deployment of the deployable fish 82 as a function of the data received from the position probe 86.

Figure 4:
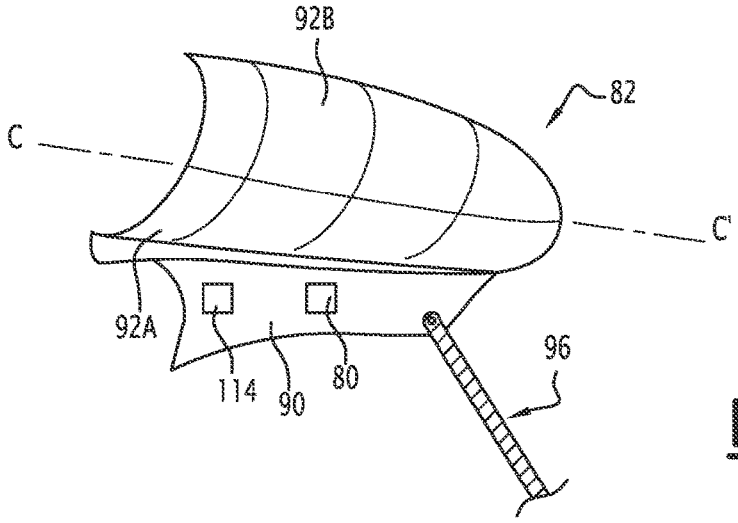
FIG. 4 is a perspective view of a fish of an upper remote sensor of the vehicle.

The deployable fish 82 has a profiled shape. As shown in FIG. 4, it comprises a lower longitudinal fin 90, and two lateral wings 92A, 92B protruding laterally from the top of the lower fin 90.

Figure 5:
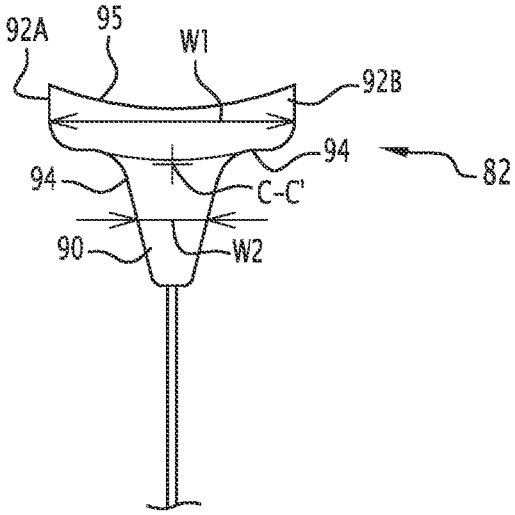
FIG. 5 is a front view of the fish, and of a part of the connection line to the support body.

In the example shown in FIGS. 4 and 5, the width W1 of the deployable fish 82 in the region of the lateral wings 92A, 92B, taken in projection in a plane perpendicular to a longitudinal axis C-C' of the fish is greater than the width W2 of the deployable fish 82 taken in the region of the lower fin 90. The lower fin 90 and the wings 92A, 92B delimit two lateral longitudinal concave lifting surfaces 94, located below the wings 92A, 92B, able to lift the fish 82 when the fish 82 moves longitudinally in the body of water.

The wings 92A, 92B also delimit an upper concave surface 95, located above the wings 92A, 92B, able to stabilize the fish 82 when moving longitudinally along axis C-C'.

In the example of FIG. 5, the wings 92A, 92B are permanently deployed away from the central part 90.

Figure 6:
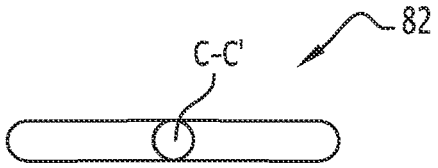
FIG. 6 is a front view of a variation of a fish, taken in a deployed position.
Figure 7:
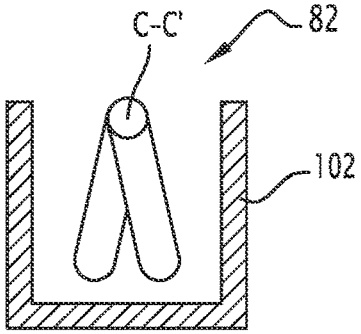
FIG. 7 is a view similar to FIG. 6 of the fish, in a retracted position on the support body.

In the embodiment of FIG. 6 and FIG. 7, the wings 92A, 92B are retractable by rotation along the longitudinal axis C-C' to reduce the size of the fish 82 when it is introduced inside the release/capture mechanism 100.

The upper deployment mechanism 84 comprises at least a line 96 mechanically and electrically connecting the fish 82 to the support body 30, a winch 98 able to unwind/wind up the line 96 to let the fish 82 move between an expanded position shown in FIG. 2 and a retracted position against the support body 30. The upper deployment mechanism advantageously comprises a release/capture mechanism 100 of the fish 82 to selectively maintain it against the support body 30 or release it.

The release/capture mechanism 100 comprises at least a funnel 102, able to guide the fish 82 towards its retracted position.

The upper cathodic protection probe 80 has also a reference electrode as described above, e.g. a zinc or Ag/AgCl reference electrode. It has a diameter comprised between 20 mm and 60 mm, and a length comprised between 100 mm and 200 mm. Its weight is comprised between 0.1 kg and 5 kg.

The line 96 is made of a tether comprising an insulation sheath, and an inner conductive core able to carry data collected by the upper cathodic protection reference electrode and/or by the position probe 86. The tether is flexible and can be wound up in a electrical powered drum of diameter comprised between 1 cm and 30 cm. The conductive core is for example made of copper, steel rubber, aluminum, carbon fibers etc. The insulation sheath can be made of polyurethane or neoprene.

The length of the line 96 in the deployed position is for example greater than 1 m, in particular greater than 3 m, and for example comprised between 3 m and 10 m. Thus, the fish 82 can extend upwardly above the support body 30 at a vertical distance higher than 3 m than above the support body 30.

The winch 98 is preferably lodged in the release/capture mechanism 100. It is powered electrically or spring loaded for deployment and/or retraction of the deployable fish 82 and of the line 96.

In the case of a spring loaded winch, the load is configured to maintain the fish 82 and the line 96 against the hydrodynamic lift and/or the buoyancy of the fish 82.

The control unit 44 is able to control the length of deployed line 96 as a function of the position of the deployable fish 82 with regard to the support body 30.

The release/capture mechanism 100 is able to allow the release of the fish 82 at a first predetermined longitudinal speed of the support body 30 and its capture below this predetermined speed.

The release/capture mechanism 100 is mounted on an upper surface of the hull 34 or lodged within a housing made in the hull to limit hydrodynamic disturbances. It extends longitudinally along the hull 34.

The position probe 86 comprise at least an angle position sensor 110, able to determine the angle of the line 96 with regard to the support body 30 in particular with regard to the longitudinal axis A-A' of the support body 30.

It also comprises at least a sensor 112 able to measure data relative to the length of line 96 deployed from the support body 30.

In an advantageous embodiment, the position probe 86 comprises at least one position sensor 114 located in the fish 82. The position sensor 114 is for example a pressure sensor able to determine the relative altitude of the fish 82 with regard to the support body 30. In this embodiment, the line 96 bears a plurality of conductors.

The sensors 110, 112, 114 are connected to the control unit 44 to allow the control unit 44 to determine the exact position of the fish 82, in particular its altitude, and to control the winch 98 to adapt the altitude of the fish 82.

In particular, the control unit 44 is able to use the positioning data obtained from the probes 110, 112, 114 to maintain the fish 82 at an altitude of at least 3 m, preferably of at least 5 m above the support body 30 when the support body 30 moves longitudinally in the body of water 16.

The operation of the autonomous underwater vehicle 10 according to the invention will be now described.

Initially, the control unit 44 of the vehicle 10 is set to follow a predefined path of inspection of a subsea structure 12. The control unit 44 receives data concerning the geographical position of each point of the predefined path, which follows approximately the path of the subsea structure 12, in particular when the subsea structure 12 comprises a pipe 22. It receives the altitude of the support body 30 relative to the subsea structure 12 at each geographical position.

Then, the autonomous underwater vehicle 10 is immersed and activated. The control unit 44 controls the power source 40 and the mobile control surface(s) 42 to autonomously drive the support body 30 along the predefined path, without intervention from the surface. The support body 30 then follows the predefined path at a speed ranging from 0.9 km/h to 4.6 km/h.

Initially, the lower proximity sensor 32 and the upper remote sensor 34 are placed in their retracted positions. The deployable arm 62 is applied against the lower surface of the profiled hull 36 to minimize the hydrodynamic disturbances. Similarly, the line 96 is wound up on the winch 80, the release/capture mechanism 100 is activated to maintain the fish 82 applied against an upper surface of the hull 36 in the funnel 102.

When a cathodic protection measurement has to be carried out in the course of the path, the control unit 44 activates the lowering mechanism 64 to lower the deployable arm 62 from the retracted position to a deployed position.

The control unit 44 advantageously controls the angle of inclination of the deployable arm 62 with regard to the support body 30 to place the lower cathodic protection probe 60 in the vicinity of the subsea structure 12, in particular, in the vicinity of the outer surface of the pipe 22, without contact with the pipe 22.

The control unit 44 also activates the release/capture mechanism 100 to release the fish 82. Under the effect of the hydrodynamic force applying on the upper concave surface 94 of the wings 92A, 92B, a lift force is applied on the fish 82. The fish 82 raises above the support body 30 while the line 96 is unwound. The fish 82 is dragged by the support body 30 to move longitudinally along the predefined path.

The control unit 44 controls the length of deployed line 96 to maintain the fish 82 at an altitude of at least 3 m above the cruising fish 30, in a reference electrolytic zone 120, in which the measurement of the upper cathodic probe 80 is not significantly affected by electric currents 29 circulating along the subsea structure 12.

Then, at each measurement point along the path, the unit 44 retrieves the data received from the lower cathodic protection probe 60 and from the upper cathodic protection probe 80 and the voltmeter determines the difference of potential between these probes 60, 80. The collected data is stored in the data storage unit 48.

A complete measurement of the cathodic protection data of the subsea unit 12 along a predetermined path is therefore carried out, without intervention at the surface, and at a very significant speed as compared to known methods.

The use of a lower proximity sensor 32 deployable under the support body 30 significantly simplifies the measurement and avoids producing a significant drag, which allows the measurement to be performed at very high speeds. The use of an expandable upper remote sensor 34 comprising a fish 82 allows for a reference measurement in a reference zone 120, directly above the autonomous underwater vehicle 10, which significantly simplifies the operation.

The data collection can be carried out totally autonomously, which lowers the costs and simplifies the operation.

During the data collection, and/or when the data collection is done, the control unit 44 transmits the data collected and stored in the data storage unit 48 to the surface, using the communication unit 50.

In a variation, the lower proximity sensor 32 and/or the upper proximity sensor 34 are equipped with a safety release mechanism. For example, in case of blocking or damage on the deployable arm 62, the lowering mechanism 64 is configured to automatically disconnect the arm 62 from the support body 30 to avoid any damage to the support body 30. Similarly, the upper deployment mechanism 84 is configured to release the deployable fish 82 and the line 96 to avoid line entanglement, in particular with the propeller 38.

Figure 8:
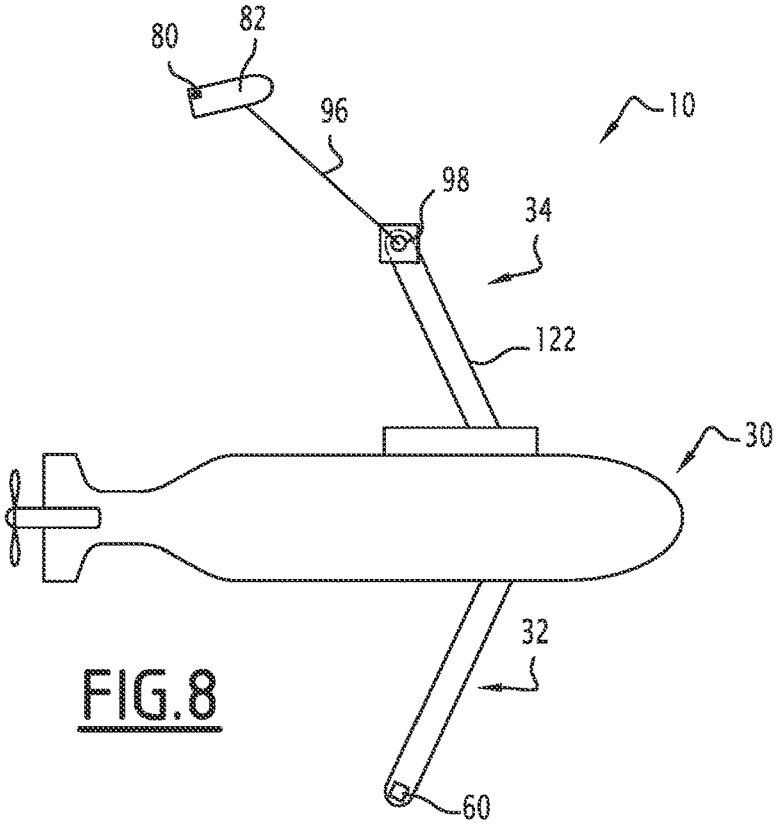
FIG. 8 is a view similar to FIG. 2 of a second autonomous underwater vehicle according to the invention.

In a variation shown schematically in FIG. 8, the upper remote sensor 34 also comprises an upper arm 122 pivotably mounted on the upper surface of the support body 30 through the upper deployment mechanism 84. In this case, the upper arm 122 is preferentially equipped with a winch 98 at its free end, the line 96 and the deployable fish 82 being connected to the winch 98.

In another embodiment (not shown), the vehicle 10 can bear a plurality of lower proximity sensors 32. These sensors may be placed in a plane perpendicular to the axis A-A' in order to span above the pipe 22. In this configuration, one makes sure there is one of the lower sensors 32 close to the subsea structure 12 despite a possible lack of accuracy on positioning the vehicle 10 above the pipe, thus increasing defect detectability.

In another variant (not shown), the vehicle 10 is a remotely operated vehicle connected to the surface with a connection link such as an umbilical. The lower proximity sensor 32 is located below the support body 30 in the retracted position and in the deployed position.

The invention claimed is:

1. An underwater vehicle inspecting a subsea structure, comprising:

a support body, configured to move along the subsea structure in a body of water;

a lower proximity sensor, deployable from the support body towards the subsea structure, the lower proximity sensor comprising a lower cathodic protection probe, the lower proximity sensor being deployable between a retracted position and a deployed position; and an upper remote sensor deployable from the support body, comprising an upper cathodic protection probe;

wherein the lower proximity sensor being located below the support body in the retracted position and in the deployed position.

2. The vehicle according to claim 1, wherein the support body defines a longitudinal moving axis, the lower proximity sensor extending below the support body along the longitudinal moving axis in the retracted position.

3. The vehicle according to claim 1, wherein the lower proximity sensor comprises a lower arm pivotable with regard to the support body around a horizontal axis.

4. The vehicle according to claim 3, wherein the lower arm is a rigid rod.

5. The vehicle according to claim 3, wherein the lower arm has a profiled shape.

6. The vehicle according to claim 3, wherein the lower arm has a length comprised between 1 m and 2.5 m.

7. The vehicle according to claim 3, comprising a control unit configured to control the movement of the lower arm between the retracted position and the deployed position to maintain the lower cathodic protection probe at a fixed altitude above the subsea structure.

8. The vehicle according to claim 1, wherein the upper remote sensor comprises a fish carrying the upper cathodic protection probe, a flexible line connecting the fish to the support body and a winch, attached to the support body to wind up/unwind the flexible line.

9. The vehicle according to claim 8, wherein the upper remote sensor comprises a release/capture mechanism of the fish.

10. The vehicle according to claim 8, wherein the length of the flexible line is greater than 1 m.

11. The vehicle according to claim 8, comprising a position probe for measuring the position of the upper cathodic protection probe relative to the support body.

12. The vehicle according to claim 11, wherein the position probe comprises a sensor for measuring the inclination of the flexible line, and a sensor for measuring the length of flexible line deployed from the support body.

13. The vehicle according to claim 11, wherein the position probe comprises a pressure sensor.

14. The vehicle according to claim 1, wherein the support body is configured to autonomously cruise along the subsea structure, without contact with the subsea structure, the vehicle being an autonomous underwater vehicle.

15. A method for inspecting a subsea structure, comprising:

moving an underwater vehicle according to claim 1 immersed in a body of water above the subsea structure;

deploying the lower proximity sensor below the support body towards the subsea structure;

measuring a potential difference between the upper cathodic protection probe and the lower cathodic protection probe while cruising along the subsea structure.

16. The method according to claim 15, wherein the cruising speed of the support body is greater than 0.9 km/h.

17. The method according to claim 15, wherein the vehicle is an autonomous underwater vehicle, the moving of the underwater vehicle comprising autonomously cruising the support body above the subsea structure without contacting the subsea structure.

18. The vehicle according to claim 6, wherein the lower arm has a length comprised between 1.5 m and 2 m.

19. The vehicle according to claim 10, wherein the length of the flexible line is comprised between 3 m and 10 m.

20. An underwater vehicle inspecting a subsea structure, comprising:

a support body, configured to move along the subsea structure in a body of water;

a lower proximity sensor, deployable from the support body towards the subsea structure, the lower proximity sensor comprising a lower cathodic protection probe, the lower proximity sensor being deployable between a retracted position and a deployed position; and an upper remote sensor deployable from the support body, comprising an upper cathodic protection probe;

wherein the lower proximity sensor being located below the support body in the retracted position and in the deployed position, wherein the lower proximity sensor comprises a lower arm pivotable with regard to the support body around a horizontal axis, and wherein the lower arm has a profiled shape.

21. An underwater vehicle inspecting a subsea structure, comprising:

a support body, configured to move along the subsea structure in a body of water;

a lower proximity sensor, deployable from the support body towards the subsea structure, the lower proximity sensor comprising a lower cathodic protection probe, the lower proximity sensor being deployable between a retracted position and a deployed position; and an upper remote sensor deployable from the support body, comprising an upper cathodic protection probe;

wherein the lower proximity sensor being located below the support body in the retracted position and in the deployed position, wherein the lower proximity sensor comprises a lower arm pivotable with regard to the support body around a horizontal axis, and wherein the lower arm has a length comprised between 1 m and 2.5 m.

* * * * *